United States Patent [19]

Heberer et al.

[11] Patent Number: 4,936,101

[45] Date of Patent: Jun. 26, 1990

[54] FAN ARRANGEMENT FOR THRU-THE-WALL UNIT

[75] Inventors: Dwight H. Heberer, Plainfield; Avinash N. Patel, Brownsburg, both of Ind.

[73] Assignee: Carrier Corporation, Syracuse, N.Y.

[21] Appl. No.: 342,000

[22] Filed: Apr. 24, 1989

[51] Int. Cl.[5] ..... F25D 23/12

[52] U.S. Cl. ..... 62/263; 62/297; 62/DIG. 16

[58] Field of Search ..... 62/262, 263, 259.1, 62/DIG. 16, 428, 324.1, 507, 297

[56] References Cited

U.S. PATENT DOCUMENTS

| | | | |
|---|---|---|---|
| Re. 21,298 | 12/1939 | Nelson . | |
| 2,299,939 | 10/1942 | Swanson . | |
| 2,304,359 | 12/1942 | Hommel . | |
| 2,486,226 | 10/1949 | Trask | 62/DIG. 16 |
| 2,702,994 | 3/1955 | Borgerd . | |
| 2,796,745 | 6/1957 | Rose . | |
| 2,847,834 | 8/1958 | Atchison | 62/263 |
| 3,299,657 | 1/1967 | Malkoff et al. | 62/259.1 |
| 3,668,887 | 6/1972 | Riello | 62/262 |
| 3,831,395 | 8/1974 | Levy | 62/263 |
| 4,367,636 | 1/1983 | Sakuma et al. | 62/262 |
| 4,424,684 | 1/1984 | Waldschmidt et al. | 62/239 |
| 4,424,686 | 1/1984 | Lapeyre et al. | 62/263 X |
| 4,733,543 | 3/1988 | Blair | 62/263 |

*Primary Examiner*—Lloyd L. King

*Attorney, Agent, or Firm*—Dana F. Bigelow

[57] ABSTRACT

In an air conditioning system having the outdoor coil disposed in a wall opening with the outdoor air being required to flow horizontally inwardly pass through the coil and then flow horizontally outwardly as it is discharged, the propeller fan is placed in a horizontal plane at the top end of the coil such that the air is caused to flow into an upper plenum where the air is turned 90 degrees to be discharged. The height of the plenum is preferably chosen to optimize the performance while minimizing the plenum height.

12 Claims, 2 Drawing Sheets

FAN ARRANGEMENT FOR THRU-THE-WALL UNIT

BACKGROUND OF THE INVENTION

This invention relates generally to air conditioning units and, more particularly, to the positioning of a fan in the outdoor coil of a thru-the-wall, packaged air conditioning system.

In residential air conditioning and heat pump systems, the evaporator and condenser sections are commonly split with one being located indoors and the other one outdoors, and with the two being connected only by refrigerant lines. In such systems, the indoor coil is normally placed in the attic or the like. In contrast, for higher capacity systems such as those used in commercial buildings, both the indoor and outdoor units are placed in the same container to constitute a so-called packaged system which is placed outdoors, normally on the roof of the building. A variation on this approach is the so-called thru-the-wall units wherein, because of the aesthetics or other structural limitations, the packaged unit is placed in the wall of a building with one coil communicating with the outdoor air and the other coil communicating with the indoor air by way of fans.

With such a thru-the-wall arrangement, it will be recognized that, unlike the outdoor coil for a split system or a packaged unit located on the roof, the path of the outdoor air must be made to flow inwardly and then be turned 180 degrees to flow outwardly after it passes through the outdoor coil. This can be done with a "blow-thru" arrangement wherein the fan is at the intake opening, or with a "draw-thru" arrangement wherein the fan is at the outlet opening. If a blow-thru arrangement is employed, then it is necessary to maintain a distance between the fan and the coil in order to have a reasonable distribution of airflow through the coil. This, in turn, requires additional space which may not be available in such a thru-the-wall installation.

Another problem with the blow-thru arrangement is that after the air has been blown through the coil and made the 90 degree turn to exit the unit, the "throw" (i.e. the velocity of the air leaving the unit) is substantially reduced, and the hot discharge air will tend to be drawn back into the intake and recirculated.

If a draw-thru arrangement is employed, then the height of the outlet opening must necessarily be as large as the diameter of the fan. Assuming a limited wall opening height, if the height of the outlet opening is made large enough to accommodate the diameter of the fan, then the height of the heat exchanger coil must be reduced. This problem has been addressed, to some extent, by the tipping of the draw-thru fan such that its axis is angled approximately 30 degrees from the horizontal plane, with the air then being drawn up through the coil and discharged at that angle from the horizontal plane. This does allow the outlet opening height to be somewhat reduced, but not to a significant degree.

With the draw-thru arrangement, it is also recognized by the Applicants that a nonuniform distribution of airflow at the inlet of the fan tends to reduce the performance level and create noise problems. That is, if the air is drawn up through the coil located in the lower portion of the casing and then turned 90 degrees to be discharged by the draw-thru fan, there will be significantly more air flowing through the lower portion of the fan than at the top portion, where the air has to travel further before it reaches the fan. Again, the tilted arrangement mentioned hereinabove will somewhat alleviate this problem, but it will still demonstrate reduced performance characteristics.

A scroll (i.e. squirrel cage) fan has been found to be practical for use in applications wherein it is desired to change the direction of airflow either before or after passing through the coil. This is true because of the inherent characteristics of such a fan. However, such a squirrel cage blower tends to use substantially more power than a propeller fan in moving the same amount of air. Accordingly, for such low static pressure conditions, a propeller fan is more economical and practical for use in outdoor fan applications.

It is therefore an object of the present invention to provide an improved fan arrangement for an outdoor coil of a thru-the-wall air conditioning unit.

Yet another object of the present invention is the provision in a thru-the-wall packaged air conditioning unit for improved airflow characteristics through the fan.

Still another object of the present invention is the provision for maximizing the height of an outdoor coil in a thru-the-wall air conditioning unit.

Still another object of the present invention is for a thru-the-wall air conditioning unit which is economical to manufacture and efficient in operation.

These objects and other features and advantages become more readily apparent upon reference to the following description when taken in conjunction with the appended drawings.

SUMMARY OF THE INVENTION

Briefly, in accordance with one aspect of the invention, the Applicants have discovered that the propeller fan for the outdoor coil of a thru-the-wall unit can be placed in a horizontal plane at the top of the coil such that it causes the outdoor air to be drawn inwardly, to pass through the coil and then be discharged upwardly into a discharge plenum where it is turned 90 degrees and then discharged outwardly. In this way, the air is drawn in through the coil while being turned 90 degrees in the process. It then enters a plenum of minimal height where it is turned 90 degrees before it is discharged with sufficient throw that it is not recirculated back into the intake.

By another aspect of the invention, the height of the plenum above the fan orifice is optimized such that the plenum offers very little resistance to flow while at the same time occupying a minimal height above the fan. The ratio of this height to the fan diameter has been found to be in the range of 0.5 to 0.6.

By yet another aspect of the invention, the placement of the propeller fan in the orifice is lower than normal (i.e. about one-fourth inch above the orifice edge rather than one-third the height of the fan) to thereby optimize the flow volume.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
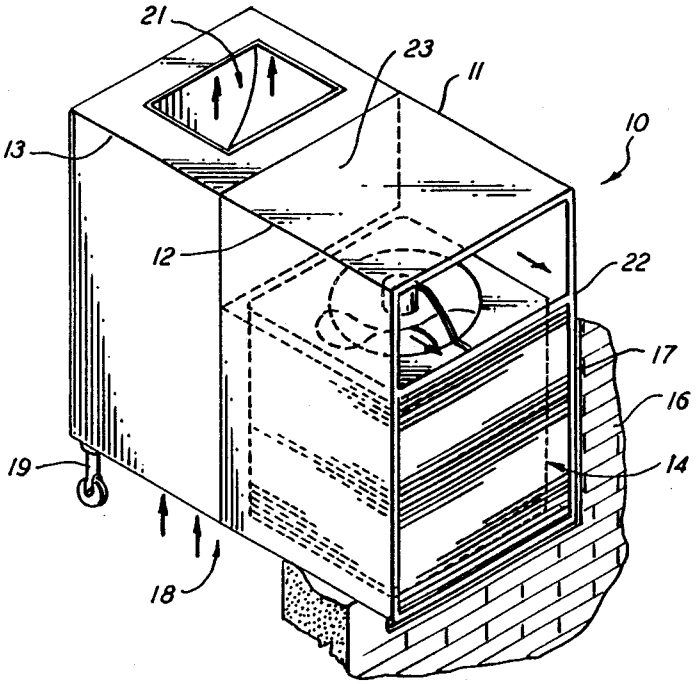
FIG. 1 is a perspective view of an installed thru-the-wall unit in accordance with the present invention.

Referring now to FIG. 1, the invention is shown generally at 10 as embodied in a thru-the-wall packaged air conditioning system with outdoor and indoor sections 12 and 13, respectively. The unit is installed in the opening 14 of a wall 16 by way of a sleeve 17 which interfaces between the opening 14 and the unit 11. The unit 11 would commonly be installed in an outdoor wall of a utility room closet having a louvered door, for example, which functions to allow the return air to enter the unit. As shown, the opening 18 is raised from the floor, a sufficient distance (e.g. 12 inches), such that that when it is cantilevered inwardly and supported by appropriate legs 19, it permits the return air to enter the bottom of the indoor section 13 with the air then passing through the indoor section 13 to be cooled or heated and then passed out through a discharge opening 21 where it enters a duct for distribution throughout the building.

The outdoor section 12, which is connected to the indoor section 13 by refrigerant lines in a standard type of refrigeration circuit, is contained in a cabinet 22 which fits closely in the sleeve 17 and is isolated from the indoor section 13 by way of a partition 23. The cabinet 22 defines a discharge plenum 24 (see FIG. 2) in its top portion and a heat exchanger cavity 26 in the bottom thereof, a horizontally disposed divider plate 27 forms the boundary between the upper discharge plenum 24 and the lower heat exchanger cavity 26 and has a central fan orifice opening 28 formed therein to provide fluid communication therebetween.

Figure 2:
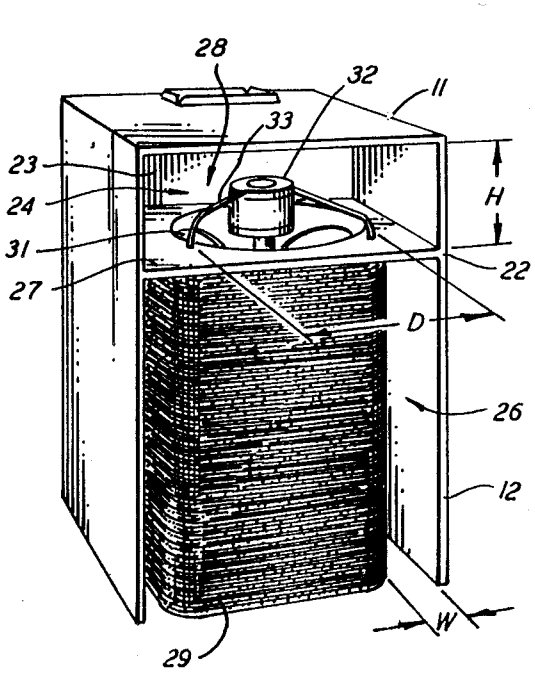
FIG. 2 is a partial front view thereof showing the top portion of the outdoor section.

Referring now to FIG. 2, the heat exchange cavity 26 is shown with a U-shaped heat exchanger coil 29 disposed therein with a distance W between the coil and the side walls of the cabinet 22. A suitable grille structure (not shown) is placed over the front of the unit so as to cover the outer side of the cabinet 22 while, at the same time, allowing outdoor air to pass into the heat exchanger cavity 26 and out the discharge plenum 24.

The propeller fan 31 and its drive motor 32 are mounted in the orifice opening 28 by way of motor mounts 33 attached to the divider plate 27. In operation, the motor 32 drives the propeller fan 31 so as to draw the air into the cavity 26, where it passes through the heat exchanger 29 and then moves upwardly through the orifice 28 and passes into the discharge plenum 24 and is then turned outwardly and discharged into the outdoor air.

The width of the discharge plenum 24 is the same as that of the lower cavity 26 and is therefore determined by the size of the coil 29. Since the diameter D of the propeller fan 31 is also a function of the size of the coil 29, the diameter of the propeller is directly related to the plenum width. The depth of the discharge plenum is also dependent on the size of the coil and the fan diameter and is essentially equal to the width thereof. It is therefore only the height, H, of the discharge plenum 24 that can be independently selected and, because of the need to minimize this dimension, it is considered a critical design feature. That is, it would be preferable to use the entire space within the cabinet 22 for the heat exchanger coil and therefore have no discharge plenum. This would be possible, for example, if the outdoor air could be discharged from the top of the cabinet. At the same time, there is a general tendency to restrict the discharge flow of air as the discharge plenum 24 is reduced in height. For this reason, the Applicants conducted tests to optimize the height H of the discharge plenum 24.

A test apparatus was rigged similar to that shown in FIG. 2 wherein an operable refrigeration circuit is included with the compressor operating to cause refrigerant to flow through the heat exchanger coil 29. The discharge plenum 24 was assembled in such a way as to allow the height H to be varied for purposes of determining the optimum height thereof (i.e. minimum height while maintaining desired performance characteristics). The object was to determine the minimum height H of the discharge plenum 24 wherein a free discharge condition exists. That is, what is the minimum height of the plenum that will allow the maximum airflow volume through the system. Since this airflow volume is directly related to the amount of heat transferred at the heat exchanger coil 29, which in turn is directly related to the saturated condensing temperature on the discharge side of the compressor, the high side head pressure (which is directly related to the temperature since it is in a two-phase saturated condition) was measured for various heights of the plenum. Since there is a relationship between the width of the plenum and the fan diameter as discussed hereinabove, the heights were then expressed as a ratio of fan diameter. The resulting test data was as follows:

TABLE I

| PSIG V. PLENUM HEIGHT (78-DEG. F. AMBIENT) | | |
|---|---|---|
| HIGH SIDE HEAD PRESSURE PSIG/ LOW SIDE PRESSURE PSIG | HEIGHT (INCHES) | HEIGHT (FAN DIA.) |
| 210/57 | 6.5 | .37D |
| 205/56 | 8.5 | .5D |
| 195/56 | 10.5 | .6D OPTIMUM FOR |
| 195/55 | 12.5 | .7D COMPACTNESS |
| 195/55 | 14.5 | .8D |

Figure 3:
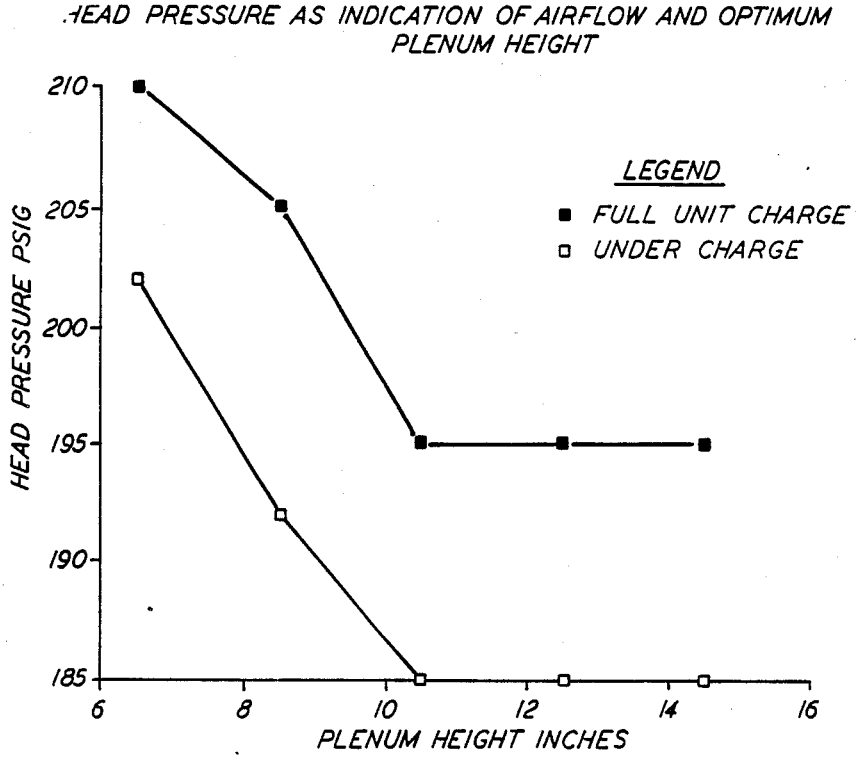
FIG. 3 is a graphic illustration showing performance characteristics thereof as a function of geometric proportions of the discharge plenum.

The above data is graphically shown in FIG. 3 wherein the high side head pressure is shown as a function of the plenum height. It will be seen that at the lower plenum heights, the head pressure is above 200 PSIG, and that at a plenum height of 10.5 inches and above, the head pressure is at a constant lower level of 195 PSIG. This indicates that at the lower plenum heights, a free discharge situation does not exist and, therefore, higher saturation condensing temperatures exist, while at a plenum height of 10.5 inches and above, the system has stabilized at the lowest possible saturated condensing temperature, or the highest volume of airflow through the coil. From this, it was concluded that any increases of the plenum height above 10.5 inches, or 0.6D (where D =fan diameter), does nothing to increase the flow of air through the system.

Simply for the purpose of verifying the data discussed hereinabove, a second test was run with the system at a lower than normal charge level. The resulting data is shown graphically in the lower graph of FIG. 3. It will be seen that the graphic form is substantially identical to the first graph, but is merely displaced, as would be expected.

Figure 4:
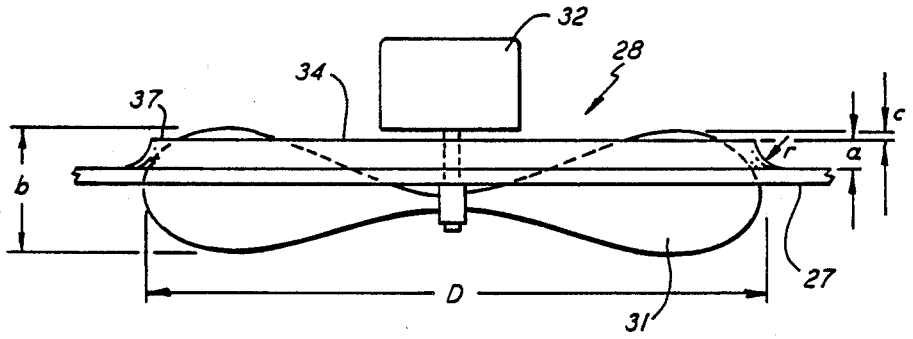
FIG. 4 is a partial front view of the fan and orifice portion of the outdoor section.

Tests were also run to determine the optimum vertical position of the propeller fan 31 in the fan orifice opening 28 as shown in FIG. 4. It will be seen that the orifice 28 is formed above the divider plate 27 by a raised ring 34 with a bell-mouth edge 36 having a radius "r" of one-half inch and a height "a" of one inch. The blade 31 has a diameter D of eighteen inches and the orifice is slightly larger at eighteen and one-half inches at its top edge 37.

It was recognized that, conventionally, the fan 31 was so placed that approximately one-third of the blade height (i.e. b=4 inches) was exposed above the orifice top edge 37. However, it was found that when the blade was substantially lowered such that that height "c" was only one-fourth inch (i.e. only one-sixteenth of the fan blade height, b), an improvement of 80 CFM was obtained.

It will be understood that the present has been described in terms of particular embodiments, but may take on any number of other forms while remaining within the scope and intent of the invention.

What is claimed is:

1. An improved outdoor section of a thru-the-wall air conditioning system having a cabinet for installation with its side walls in close proximity to the surrounding structural walls and containing adjacent inlet and outlet sections separated by a divider plate with each of said sections being open to the outdoor air by way of inlet and outlet openings, respectively, comprising:

a heat exchanger coil disposed in said inlet section and being adapted to conduct the flow of refrigerant therein;

a fan mounted at one end of said coil nearest said outlet section and being operational for drawing outdoor air into said inlet section, through said coil and out the inner portion of said coil to the outlet section; and said outlet section defining a plenum into which air may be discharged from said fan and then turned substantially 90 degrees to be discharged from the outlet opening.

2. An improved outdoor section as set forth in claim 1 wherein said fan is of a propeller type with its axis so oriented that its opposite ends point towards the inlet and outlet sections, respectively.

3. An improved outdoor section as set forth in claim 1 wherein said fan is disposed in an orifice formed in said divider plate.

4. An improved outdoor section as set forth in claim 1 wherein the height of said plenum above said divider plate is limited to a maximum of .6 times the diameter of said propeller fan.

5. An improved outdoor section as set forth in claim 1 wherein the height of said plenum above said divider plate is at least 0.5 times the diameter of said propeller fan.

6. An improved outdoor section as set forth in claim 3 wherein said propeller fan is placed in said orifice in such way that less than one-third of the propeller blade height is located above the orifice top edge.

7. An improved outdoor section as set forth in claim 6 wherein said propeller fan is placed in said orifice in such a way that approximately one-sixteenth of the propeller blade height is located above the orifice top edge.

8. In a refrigeration system of the type having a heat exchanger coil and an associated fan disposed in a wall such that the outdoor air is caused to flow inwardly, pass through the coil and then flow in the opposite direction outwardly, an improved outdoor heat exchanger assembly comprising:

a casing for insertion into a wall opening and having adjacent air inlet and outlet openings formed therein for fluid communication with the outdoor air;

a heat exchanger coil disposed in one end of said casing, adjacent said air inlet opening;

a plenum formed in the other end of said casing adjacent said air outlet opening; and a motor driven propeller fan disposed between said heat exchanger coil and said plenum with its axis aligned substantially normally with the directions of inward and outward airflow, such that when it is in operation, the outdoor air is caused to flow into said air inlet opening, through said heat exchanger coil, into said plenum and out said air outlet opening.

9. An improved outdoor heat exchanger assembly as set forth in claim 8 wherein said propeller fan is so oriented as to operate in a horizontal plane.

10. An improved outdoor heat exchanger assembly as set forth in claim 9 wherein said propeller is disposed in an orifice associated with a divider plate which divides said coil end of the casing and said plenum, and further wherein said fan in so located with respect to said orifice that approximately one-sixteenth of the fan height lies above a top edge of said orifice.

11. An improved outdoor heat exchanger assembly as set forth in claim 8 wherein the height of said plenum is limited to a maximum of 0.6 times the diameter of said propeller.

12. An improved outdoor heat exchanger assembly as set forth in claim 8 wherein the height of said plenum is at least 0.5 times the diameter of said propeller.

* * * * *